US005246233A

United States Patent [19]

Sheltman et al.

[11] Patent Number: 5,246,233

[45] Date of Patent: Sep. 21, 1993

[54] DEVICE FOR PUTTING TRAINING

[76] Inventors: R. Sheltman, 1948 W. 700 S., St. George, Utah 84770; David Sheltman, 65 Havenwood, Irvine, Calif. 92714

[21] Appl. No.: 907,226

[22] Filed: Jul. 1, 1992

[51] Int. Cl.[5] ..... A63B 69/36

[52] U.S. Cl. ..... 273/186.1; 273/192

[58] Field of Search ..... 273/187 R, 187 A, 187 B, 273/192, 186.1, 191 R; 434/252

[56] References Cited

U.S. PATENT DOCUMENTS 3,658,344 4/1972 Kimble ..... 273/187 R
3,868,116 2/1975 Ford et al. ..... 273/187 R X

FOREIGN PATENT DOCUMENTS 2194448 3/1988 United Kingdom ..... 273/187 R

*Primary Examiner*—George J. Marlo

[57] ABSTRACT

An apparatus is provided for training a person to putt a golf ball more accurately. A pair of guide rails each have a generally vertical guide surface and a ground spike for removably fixing the rail on a putting green, carpet, or the like. A horizontal upward facing flange along the top edge of each guide surface maintains rigidity of each guide surface and includes a series of spaced apart guide marks parallel to the guide surface and visible from above. A flat, rigid connecting rod has an elongated slot extending linearly over the length of the rod, has a arcuate segment at one end, and includes a series of spaced apart alignment marks set at right angles to the slot. The slot slidably accepts an attaching pin of one rail for mounting the rail rotatably and slidably in the slot. As such, the rail may be moved to any position along the slot. A pivot mount rotatably accepts an attachment pin of the other of the guide rails so that the other of the rails may be rotated with respect to the connecting rod.

5 Claims, 3 Drawing Sheets

DEVICE FOR PUTTING TRAINING

FIELD OF THE INVENTION

This invention relates generally to a device for golf training, and, more particularly, is directed towards a guide rail device for putting training.

BACKGROUND OF THE INVENTION

Various devices exist for training a person to more accurately strike a golf ball while putting. Accurate putting requires precisely aligning a putter head with the ball in a desired direction, as well as selecting a proper backswing distance. As such, putting training devices typically are designed to improve one or both of these skills.

For example, U.S. Pat. No. 4,805,912 to Hickman discloses a golf putting teaching aid that consists of a generally rectangular putting surface with straight indicia to represent a proper golf ball path. Such a device, however, is relatively large and therefore difficult to transport. Moreover, the surface of such a device is artificial and therefore not representative of an actual putting green with real grass. As such, a golf ball will travel differently on such a device than it will on an actual putting green. Further, while such a device is adequate for teaching one how to initially address the golf ball with the face of the putter, it is difficult with such a device to learn how to maintain proper putter positioning throughout the swing. A similar drawback exists with the device disclosed by Bott in U.S. Pat. No. 4,805,913, which also has a straight indicia line on a surface for indicating the path of a golf ball. Neither of these devices provides much assistance in properly orienting a putter throughout the golf swing.

Another training device, disclosed in U.S. Pat. No. 4,133,535 to Marsh, teaches a guide member that snaps onto a putter shaft and is confined to linear horizontal movement along a guide rail supported above the ground. Such a device discourages the putter from rotating out of alignment during the swing. However, such a device changes the feel of a natural putting swing since the device is attached to the putter and inhibits incorrect movements. As a result, a person trained on such a device will experience a different feel during putting in actual play or when not using such a device. After repeated use of such a device, a person might actually come to rely on the training device to putt the golf ball correctly.

Clearly, then, there is a need for a putting training aid that teaches a person not only how to properly position the putter to the ball initially, but that also helps the person learn to maintain a proper putter position throughout the entire swing. further, such a device would not interfere with the putter during the swing, allowing the swing to feel completely natural. Such a needed device would not cause the ball to behave unnaturally after being hit. Further, such a needed device would be extremely simple to manufacture, would be inexpensive, and would collapse so as to be easily carried or stored in a golf bag, or the like. The present invention fulfills these needs and provides further related advantages.

SUMMARY OF THE INVENTION

The present invention is a device for training a person to putt a golf ball more accurately. A pair of guide rails each have a generally vertical guide surface and a fixing means for removably fixing the rail on the putting green, carpet, or other soft surface. A horizontal stiffening flange along the top edge of each guide surface maintains rigidity of each guide surface and includes a series of spaced apart guide marks parallel to the guide surface and visible from above. A flat, rigid connecting rod has an elongted slot extending linearly over the length of the rod, has an arcuate segment at one end, and includes a series of spaced apart alignment marks set at right angles to the slot. The slot slidably accepts an attaching means of one rail for mounting the rail rotatably and slidably in the slot. As such, the rail may be moved to any position along the slot. A pivotal mounting means rotatably accepts an attachment means of the other of the guide rails so that the other of the rails may be rotated with respect to the connecting rod.

The device may be collapsed for storage by positioning one of the guide rails adjacent to the other of the guide rails such that the connecting rod and each guide rail are aligned mainly colinearly, and the attachment means of the one of the guide rails is positioned within the arcuate segment of the slot. The device may be used by positioning the two guide rails apart with the guide surfaces parallel, as determined by aligning the guide surfaces with the alignment marks on the connecting rod, and with the connecting rod lying approximately at right angles to the guide surfaces. The rail fixing means holds the guide rails on the soft surface. With the guide surfaces separated by at least the length of a putter head and aligned with a desired putting direction, a golf ball is placed on the soft surface between the guide surfaces. When putting, a person takes care to keep the putting head in alignment with the guide marks, and in this manner more easily learns how to maintain alignment of the face of the putter through a putt swing for more accurate ball strikes.

The present invention teaches a person not only how to properly position the putter to the ball initially, but that also helps the person learn to maintain a proper putter position throughout the entire swing. Further, the present invention does not make contact or otherwise interfere with the putter or the ball during or after the swing, thereby allowing the swing and its results to feel completely natural to the golfer. Further, the present invention is relatively simple to manufacture, is therefore inexpensive, and collapses so as to be easily carried or stored in a golf bag, or the like. While the rules of golf prohibit use of such a device during actual play, clearly such a device is beneficial while practicing putting. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
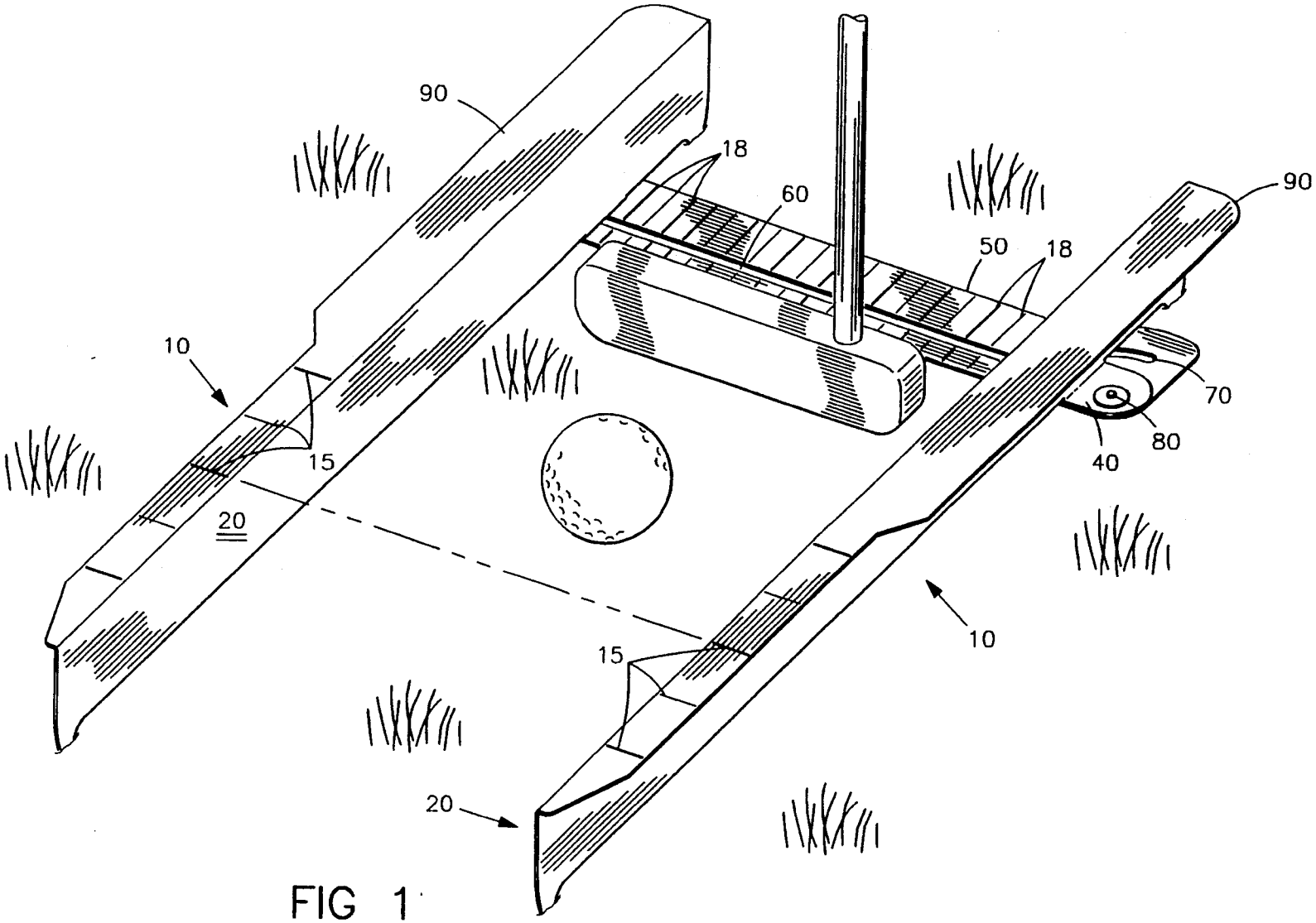
FIG. 1 is a perspective illustration of the invention, illustrating two guide rails of the invention, separated to allow a putter head to hit a golf ball.
Figure 3:
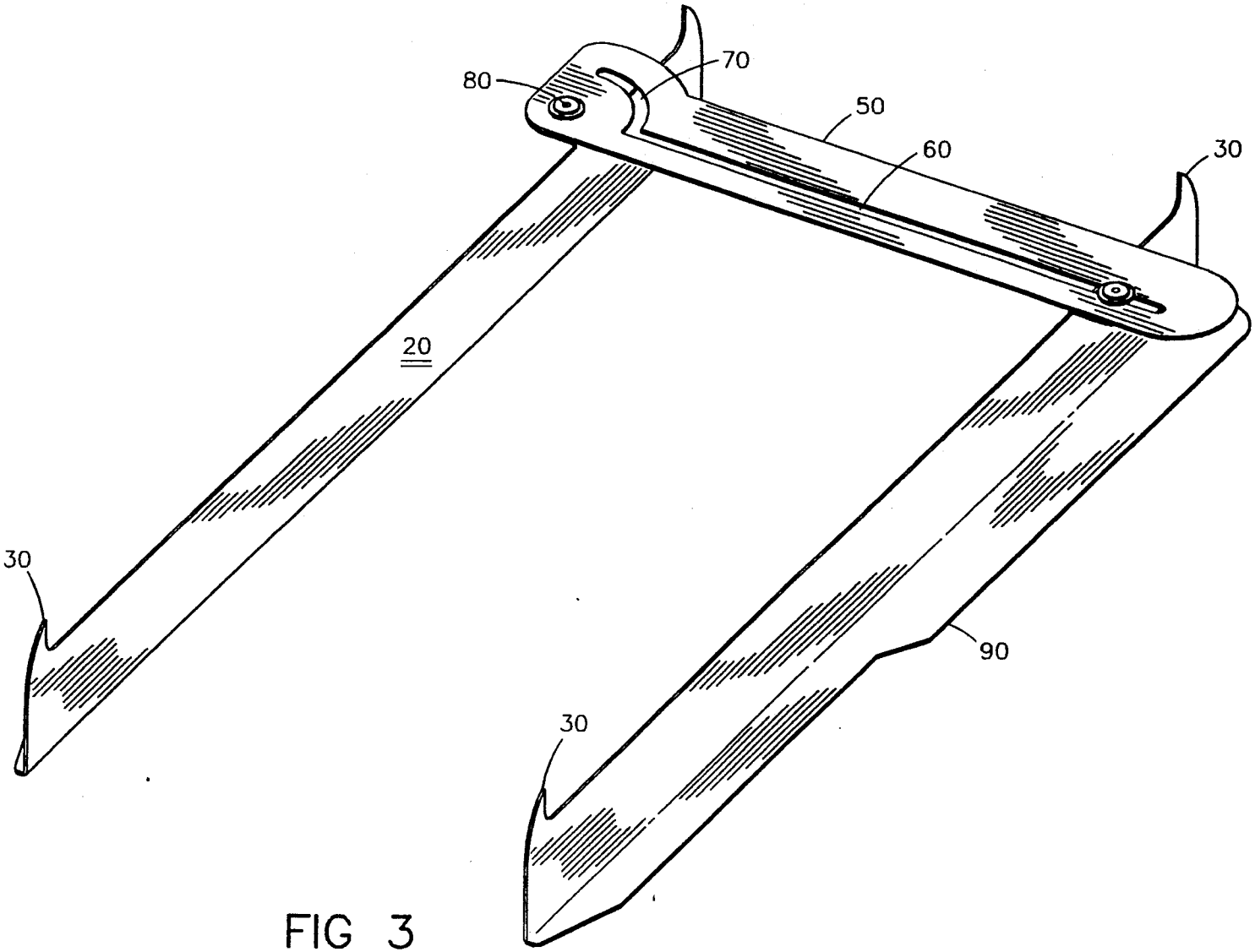
FIG. 3 is a perspective illustration of the invention, illustrating a slot and arcuate segment of the connecting rod.

FIGS. 1 and 3 show a device for putting training. A pair of guide rails 10 each have a generally vertical guide surface 20 and a fixing means 30 for removably fixing the rail 10 on a soft surface, such as a putting green, carpet, or the like. Such a fixing means 30 may be formed as an extension of each end of each guide surface 20 as a downwardly extending spike (FIG. 3). Preferably, each guide rail 10 is a mirror image of the other guide rail 10, and each guide surface 20 is the approximate height of a regulation play golf ball and at least 16 inches long. Each rail 10 further includes a horizontal upward facing surface 90 with a series of spaced apart indicia guide marks 15 set at right angles to the guide surface 20 and visible from above. Preferably, each horizontal upward facing surface 90 further acts as a stiffening flange for maintaining rigidity of each guide surface 20 (FIG. 1).

A flat, rigid connecting rod 50 has an elongated slot 60 extending linearly over the length of the rod 50, an arcuate segment 70 at one end, and a series of spaced apart alignment marks 18 set at right angles to the slot 60. The slot 60 slidably accepts a pivoting, sliding attaching means 80 of one rail 10 for mounting the one rail 10 rotatably and slidably in the slot 60. As such, the rail 10 may be moved to any position along the slot 60. A pivotal mounting means 40, such as a pivot mounting hole, rotatably accepts the pivoting, sliding, attaching means 80 of the other of the guide rails 10 so that the other of the rails 10 may be rotated with respect to the connecting rod 50. Preferably, each rail 10 and the connecting rod 50 are manufactured from a suitably rigid sheet material, such as sheet aluminum or plastic. The attachment means 40 of each guide rail 10 may be an attachment pin, or the like.

Figure 2:
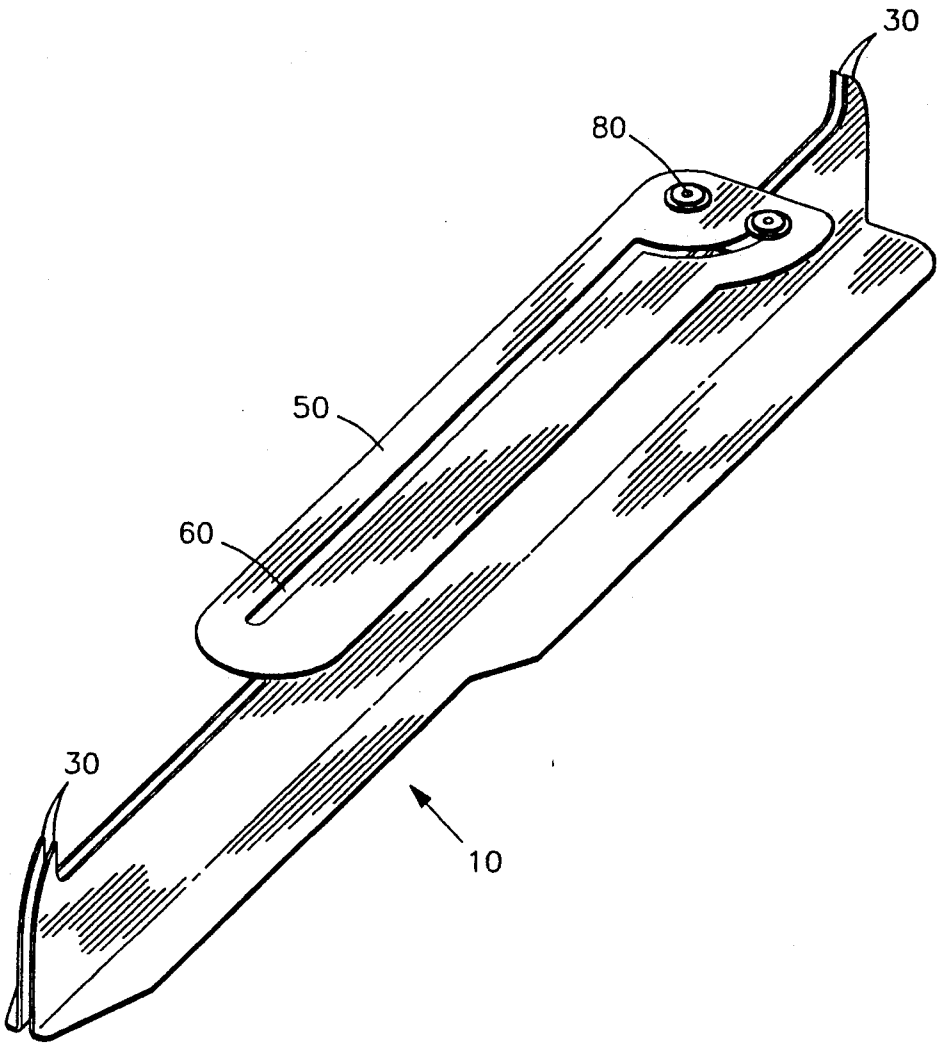
FIG. 2 is a perspective illustration of the invention, illustrating the two guide rails and a connecting rod of the invention in a collapsed configuration.

The device may be collapsed for storage by positioning one of the guide rails 10 adjacent to the other of the guide rails 10 such that the connecting rod 50 and each guide rail 10 are aligned mainly colinearly, and the pivoting, sliding attaching means 81 of the one of the guide rails 10 is positioned within the arcuate segment 70 of the slot 60 (FIG. 2).

The device may be used by positioning the two guide rails 10 apart with the guide surfaces 20 parallel, as determined by aligning surfaces 20 with alignment marks 18 on the connecting rod 50, and with the connecting rod 50 lying at right angles to the guide surfaces 20. The rail fixing means 30 holds the guide rails 10 on the soft surface (FIG. 1). With the guide surfaces 20 separated by at least the length of a putter head and aligned with a desired putting direction, a golf ball is placed on the soft surface approximately midway between the guide surfaces 20. When putting, a person takes care to keep the putting head in alignment with the guide marks 15, and in this manner more easily learns how to maintain alignment of the face of the putter through a putt swing for more accurate ball strikes.

Since connecting rod 50 is a flat member lying on the ground, the putter head can pass over it freely. Thus the transverse position of the putter head with respect to the ball, the backswing distance, and the straightness and the alignment of the golfer's putting swing are easily and directly taught by the device.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. A device for putting training comprising:

a pair of ball guiding rails, each of the rails providing a vertical guide surface, a horizontal upward facing surface, a means for removably fixing the rail on a soft surface, a series of spaced-apart guide marks on the horizontal surface, set at right angles to the guide surfaces and visible from above, and a pivoting attaching means for pivotally connecting the rail to;

a flat, rigid, connecting rod, said rod providing;

an elongated slot extending linearly over the length thereof and having an arcuate segment at one end, the slot slidably accepting the attaching means of one of the guide rails for mounting the rail rotatably and slidably in the slot so the rail may be moved to any position in the slot, and a series of spaced apart alignment marks set at right angles to the slot, and;

a pivotal mounting means for rotatably accepting the attachment means of the other of the guide rails so that the other of the rails may be rotated with respect to the connecting rod;

so that for storage the one of the guide rails is positionable adjacent to the other of the guide rails, the two guide rails being positionable so that the rails and the connecting rod are aligned colinearly, the attachment means of the one of the guide rails being positioned thereby within the arcuate segment of the slot; and so that in use the two guide rails are positionable apart with the guide surfaces mainly parallel, the connecting rod lying at right angles to the guide surfaces as judged by the juxtaposition of the guide surfaces relative to the alignment marks, the rail fixing means holding the guide rails on the soft surface;

whereby the guide surfaces, being spread apart at least the length of a putter head, are aligned with a desired putting direction, a golf ball is placed on the soft surface between the guide surfaces and the face of the golf club is maintained in alignment with the guide marks to facilitate learning how to maintain alignment of the face of the putter throughout a putt swing for more accurate ball strikes.

2. The device of claim 1 wherein the guide surfaces are approximately the height of a golf ball and are at least 16 inches long whereby the guide surfaces provide retention of the ball during the club swing and visual alignment over a distance approximately the length of an average golf putting swing.

3. The device of claim 1 wherein the guide rails further include a horizontal upward facing surface along the top edge of the guide surface for maintaining guide surface rigidity and for exhibiting indicia.

4. The device of claim 1 wherein the one guide rail is formed as a mirror image of each other of the guide rails.

5. The device of claim 1 wherein the fixing means is formed as an extension at each end of the guide surface as a downwardly extending spike.

* * * * *